US005758672A

United States Patent [19]

Chou

[11] Patent Number: 5,758,672

[45] Date of Patent: Jun. 2, 1998

[54] HAIR CLIP

[76] Inventor: Kuo-Hua Chou, No. 17, Alley 10, Lane 118, Su-Wei Rd., Wu-Ku Hsiang, Taipei County, Taiwan

[21] Appl. No.: 671,337

[22] Filed: Jun. 27, 1996

[51] Int. Cl.[6] ..... A45D 8/20

[52] U.S. Cl. ..... 132/275; 132/277

[58] Field of Search ..... 132/276, 277, 132/278, 279, 275; 24/507, 521, 510, 509

[56] References Cited

U.S. PATENT DOCUMENTS

| | | | |
|---|---|---|---|
| 1,152,739 | 9/1915 | Krementz et al. | 24/510 |
| 1,638,979 | 8/1927 | Broking | 24/507 |
| 1,861,109 | 5/1932 | Campbell | 132/277 |
| 2,261,825 | 11/1941 | Brainard | 132/278 |
| 2,699,789 | 1/1955 | Goodman | 132/275 |
| 2,818,871 | 1/1958 | Beaudry | 132/278 |
| 3,204,647 | 9/1965 | Dekel | 132/277 |
| 5,109,878 | 5/1992 | Kou-hua | 132/278 |

FOREIGN PATENT DOCUMENTS

| | | | |
|---|---|---|---|
| 740681 | 8/1966 | Canada | 132/277 |
| 787275 | 9/1935 | France | 132/277 |
| 2079597 | 1/1982 | United Kingdom | 132/277 |

*Primary Examiner*—Todd E. Manahan

*Attorney, Agent, or Firm*—Morton J. Rosenberg; David I. Klein; Jun Y. Lee

[57] ABSTRACT

A hair clip including an upper clip portion and a lower clip portion pivotally connected at a their ends at a suitable position. These clip portions are elongate and curved structures. The upper clip portion is provided with a tongue-like recess at an upper side thereof with a plurality of projections extending downwardly along a center-line of the upper clip portion. The lower clip portion has a downwardly extending projection at a front end such that the hair clip will not scratch or hurt the head of the wearer. The lower clip portion is provided with an array of alternately projecting portions at either lateral side for matching the projections of the upper clip portion. By means of a torsion spring disposed at one end of the hair clip, the upper and lower clip portions may grip the hair of the wearer with a suitable force. The upper and the lower clip portions are pivotally joined by a couple of symmetrical pivotal portions.

7 Claims, 9 Drawing Sheets

HAIR CLIP

BACKGROUND OF THE INVENTION (a) Field of the Invention

The present invention relates generally to a hair clip, and more particularly to a hair clip with enhanced clipping effects which will not damage the hair.

(b) Description of the Prior Art

Conventional hair clips are generally comprised of two opposing curved gripping plates or leaves with a spring element. Both gripping plates of conventional hair clips have smooth curved surfaces, and the gripping area is narrow so that the gripping force is unevenly distributed. As a result, the hair clip may slip off the hair. In order to overcome such a drawback, the hair clips are provided with a greater spring force to increase its gripping effects. However, the gripping force may be too great as to hurt the hair or even distort the hair style. How to enhance the gripping effects without damaging the hair is therefore the subject of hair clip manufacturers' concern.

SUMMARY OF THE INVENTION

Accordingly, a primary object of the present invention is to provide a hair clip comprising an upper leaf and a lower leaf each of which is provided with alternate raised portions and recesses to achieve a suitable gripping effect.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
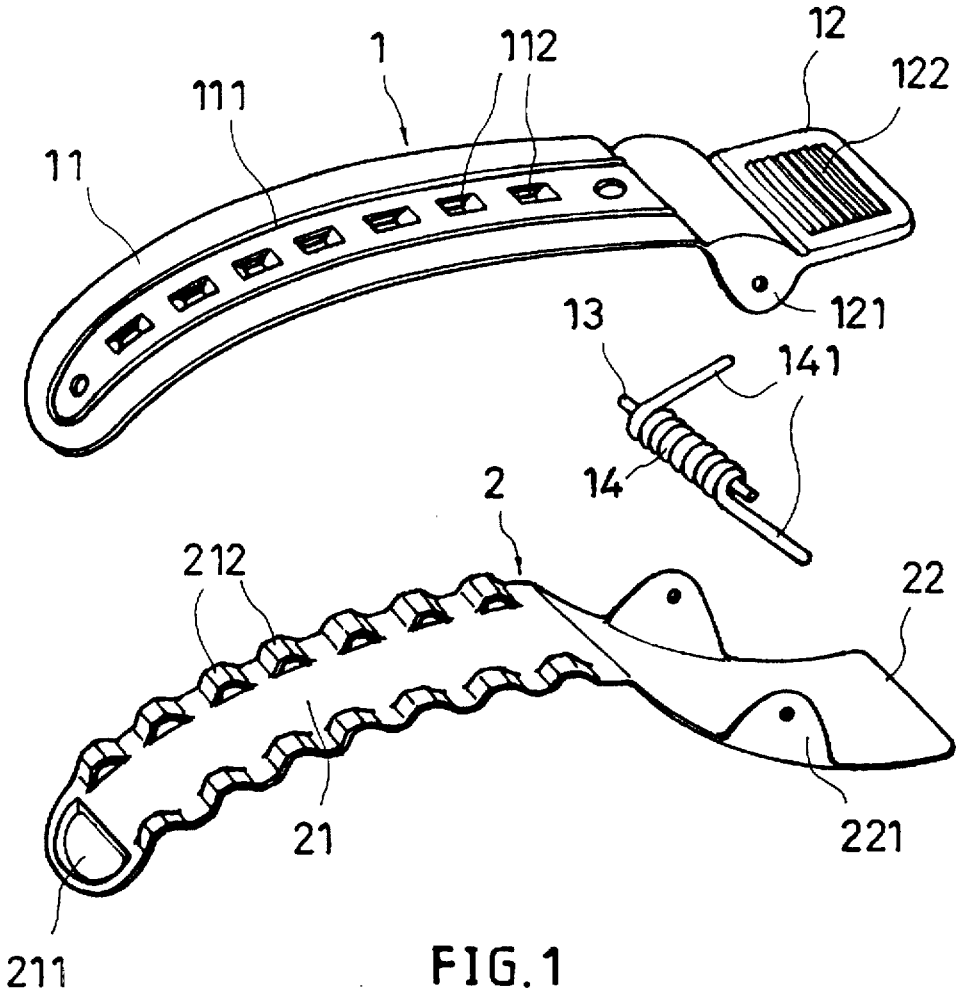
FIG. 1 is an elevational exploded view of a first preferred embodiment of the hair clip of the invention.
Figure 2:
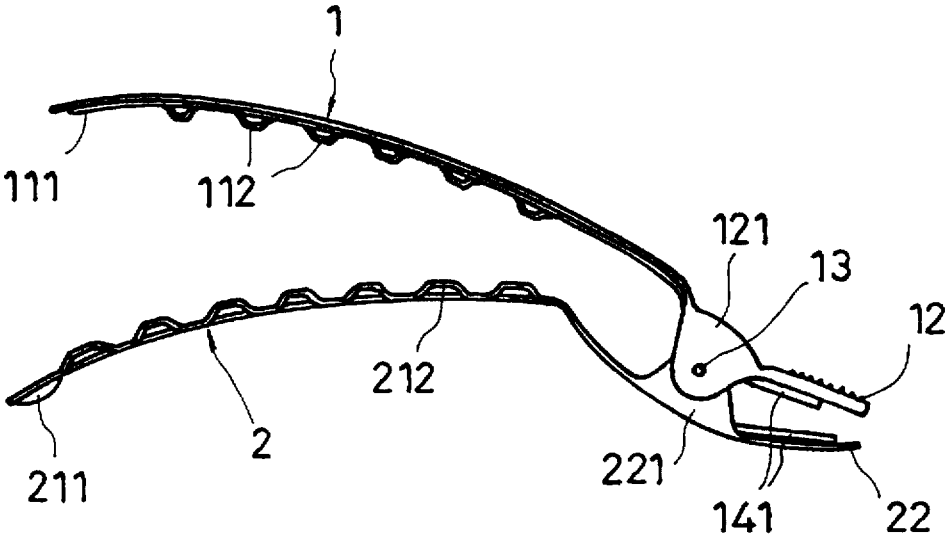
FIG. 2 is a side view of the first preferred embodiment of the hair clip of the invention.

With reference to FIGS. 1 and 2, a first preferred embodiment of the hair clip according to the present invention essentially comprises an upper clip portion 1 and a lower clip portion 2. A front portion of the upper clip portion 1 is configured to be an elongate curved upper leaf 11 of a suitable length, while a rear portion of the upper clip portion 1 is provided with a finger grip portion 12. A substantially tongue-like recess 111 is provided at a suitable position on an upper side of the upper leaf 11. The recess 111 may enhance the strength of the upper clip portion 1. Along the center-line of the upper leaf 11, the recess 111 is provided with a plurality of projections 112 which project downwardly and are spaced apart from each other at a suitable distance. A pivot portion 121 is provided at either lateral side of the upper clip portion 1 near its rear end. A non-skid surface 122 is provided on the upper side of the finger grip portion 12.

Likewise, the lower clip portion 2 is provided with a lower leaf 21 which has a front portion having a length and a curvature matching those of the upper leaf 11. A rear portion of the lower clip portion 2 is provided with a curved finger grip portion 22. A front end of the lower leaf 22 is provided with a bulging portion 211 of a relatively large area and projecting downwardly so that there is a suitable distance between the front portion of the lower leaf 21 and the head to prevent hurting the head of the wearer. Both sides of the upper surface of the lower leaf 21 are provided with a plurality of projections 212 which are in an alternate arrangement with the projections 112 projecting from the lower surface of on the upper leaf 11. Both lateral sides of the curved finger grip portion 22 are each provided with an upwardly extending pivot portion 221 which may be pivotally connected with the pivot portions 121 of the upper clip portion 1 by means of a pivotal rod 13. The pivotal rod 14 is fitted with a torsion spring 14 which has a torsion arm 141 at each end. One of the torsion arms 141 extends upwardly to urge against a lower side of the finger grip portion 12 of the upper clip portion 1, while the other of the torsion arm 141 extends substantially downwardly to urge against an upper side of the curved finger grip portion 22 of the lower clip portion 2, enabling the upper clip portion 1 and the lower clip portion 2 to achieve a gripping effect.

By utilizing the torsion spring 14 and the slight resilience of the upper and lower portions 1 and 2, hair 3 may be held between the upper and lower portions 1 and 2. The alternate arrangement of the projections 112 on the lower surface of the upper leaf 11 and the projections 212 on the upper surface of the lower leaf 21 may hold the hair 3 therebetween such that the hair 3 is distributed therebetween in a wavy form and the hair clip of the invention will not easily slip off the hair 3. The suitable gripping effect afforded by the hair clip of the invention will not damage the hair 3.

Figure 3:
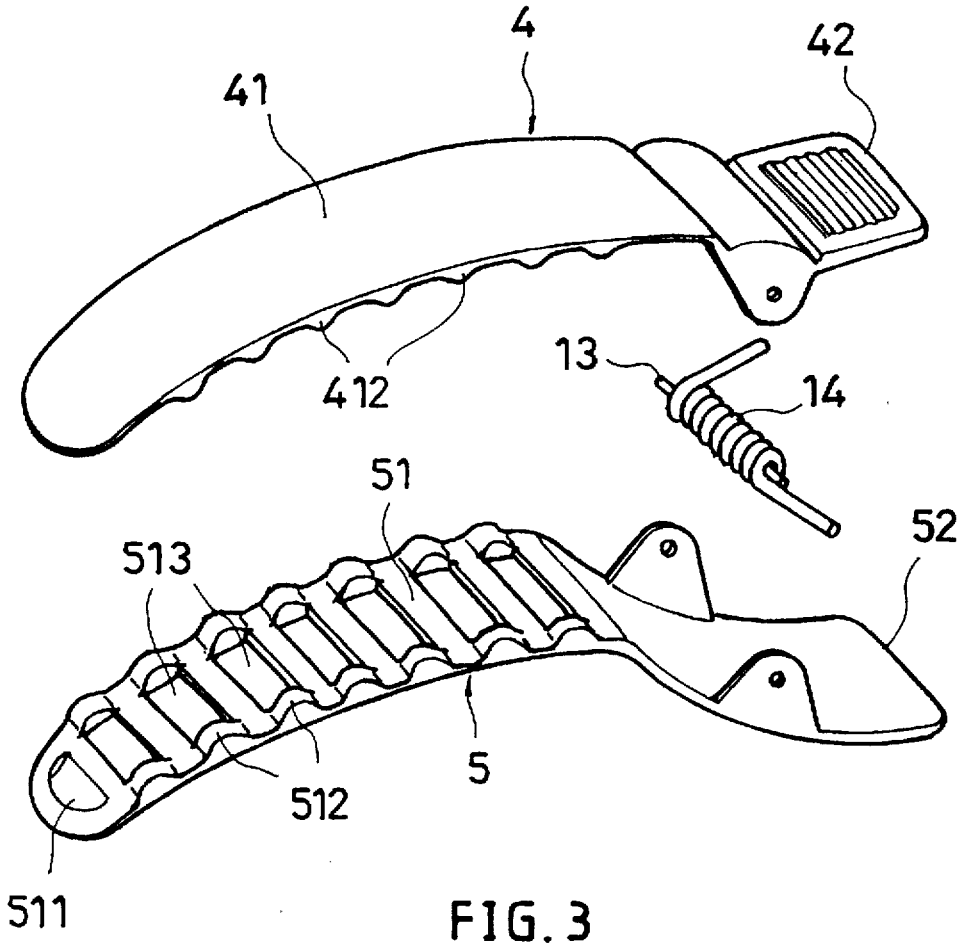
FIG. 3 is an elevational exploded view of a second preferred embodiment of the hair clip of the invention.
Figure 3B:
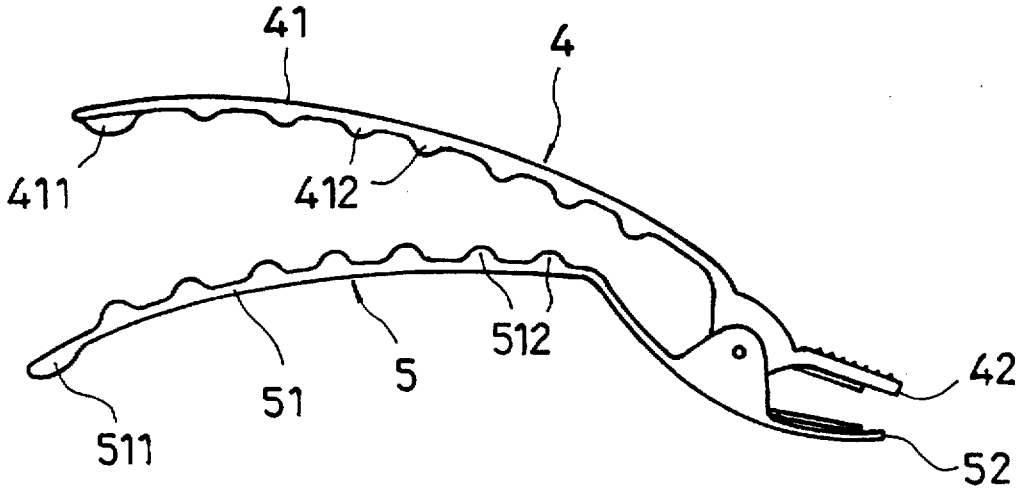
FIG. 3B is a side view of the second preferred embodiment of the hair clip of the invention.
Figure 3A:
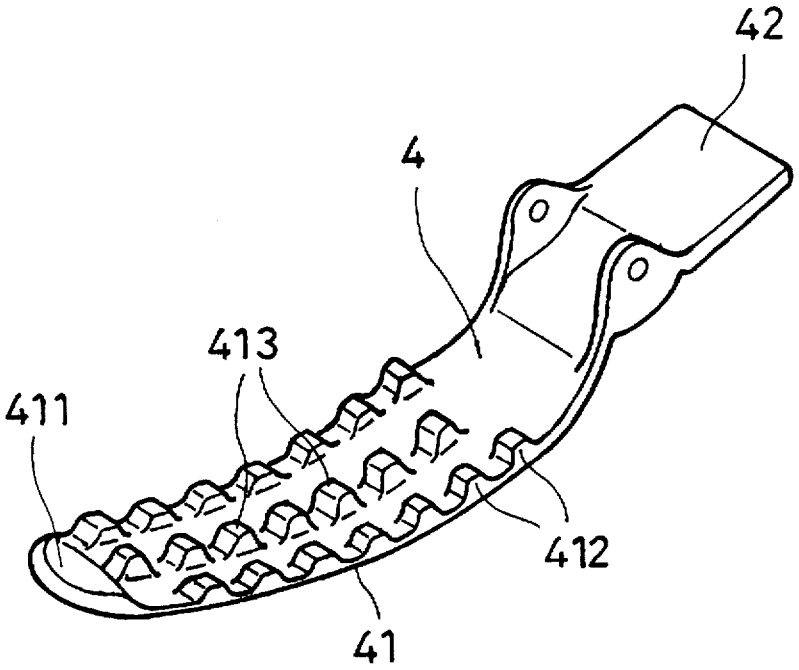
FIG. 3A is a side view of an upper clip portion of the hair clip of the second preferred embodiment of the invention.
Figure 4:
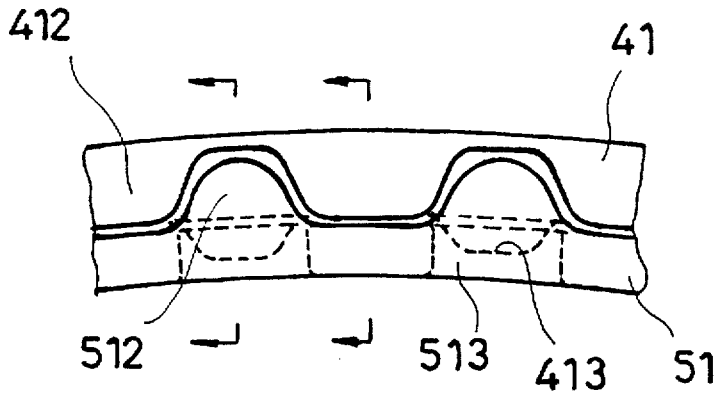
FIG. 4 is a partially enlarged side view of the second preferred embodiment of the hair clip of the invention.
Figure 4A:
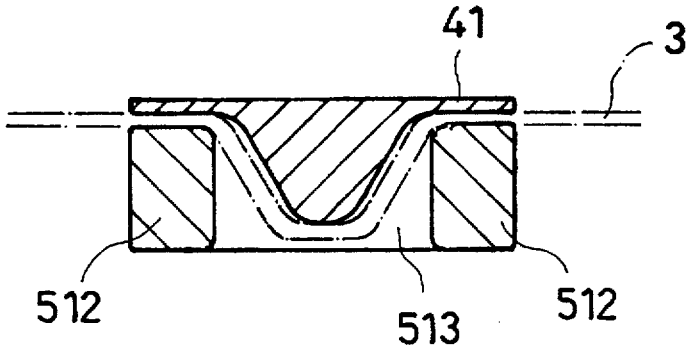
FIG. 4A is a partially sectional view of the engagement of the projections of the second preferred embodiment of the hair clip of the invention.
Figure 4B:
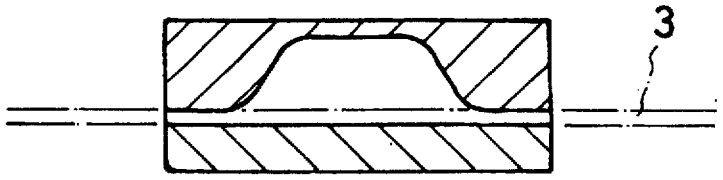
FIG. 4B is a partially sectional view of the engagement of the projections of the second preferred embodiment of the hair clip of the invention.
Figure 5:
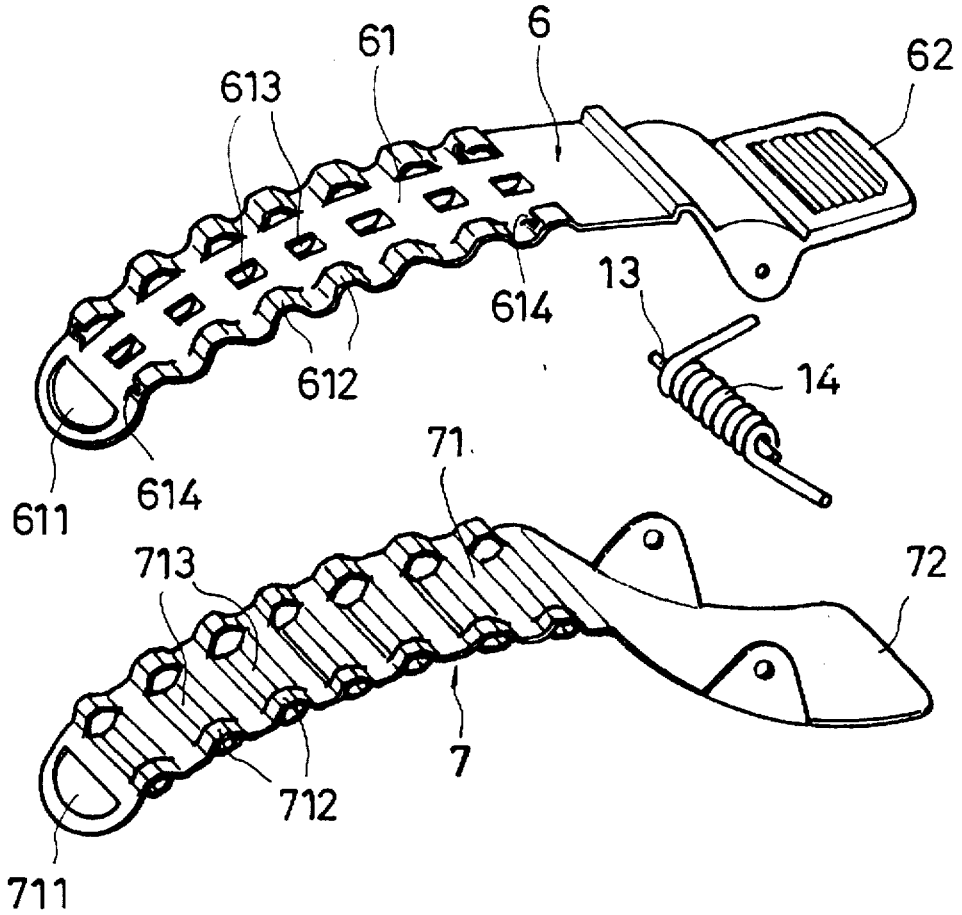
FIG. 5 is an elevational exploded view of a third preferred embodiment of the hair clip of the invention.
Figure 5A:
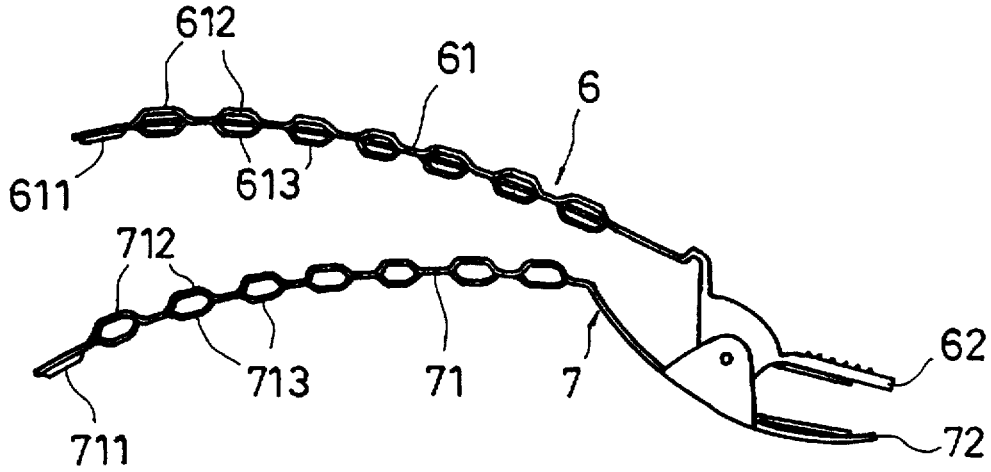
FIG. 5A is a side view of the third preferred embodiment of the hair clip of the invention.
Figure 6:
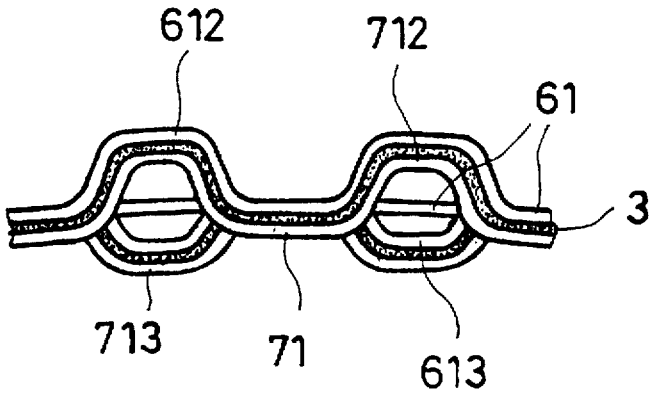
FIG. 6 is a partially enlarged side view of the third preferred embodiment of the hair clip of the invention.
Figure 6A:
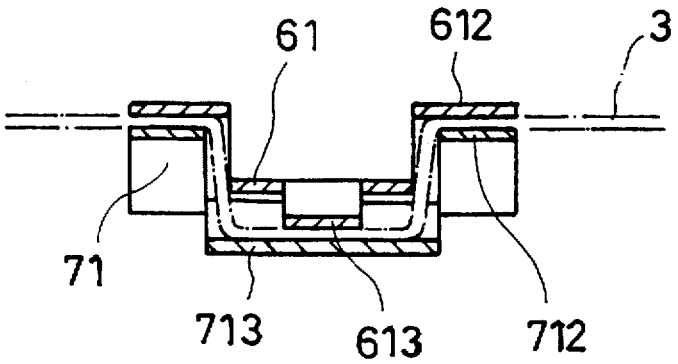
FIG. 6A is a sectional view of the third preferred embodiment of the hair clip of the invention.
Figure 6B:
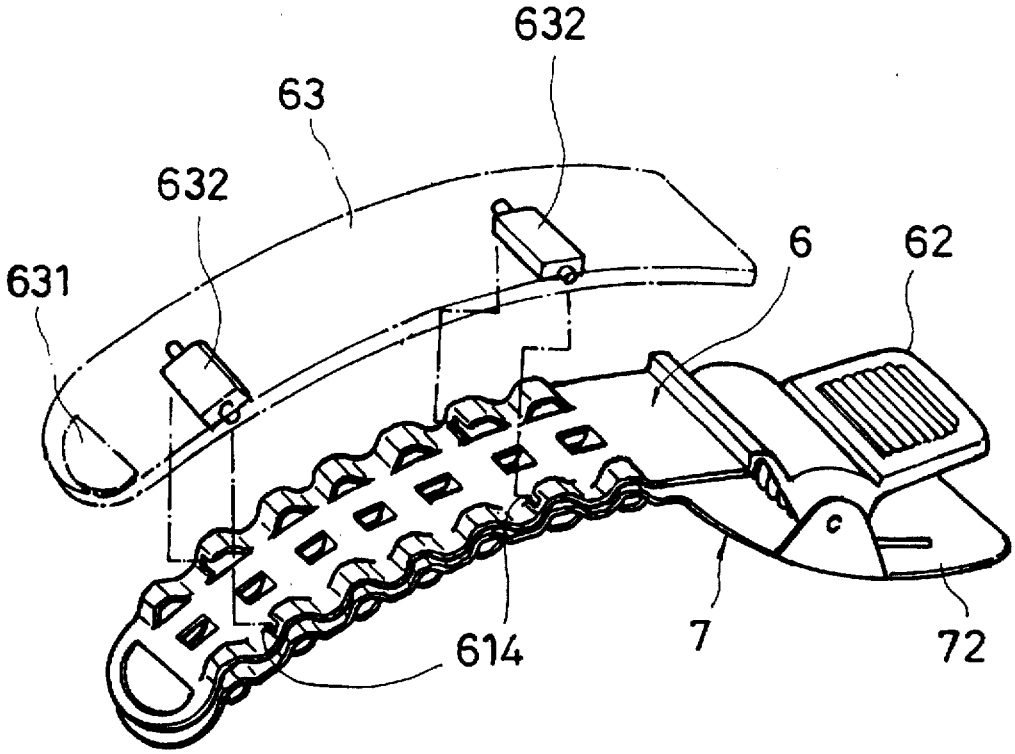
FIG. 6B is an elevational exploded view of a decorative plate of the hair clip according to the third preferred embodiment of the invention.
Figure 7:
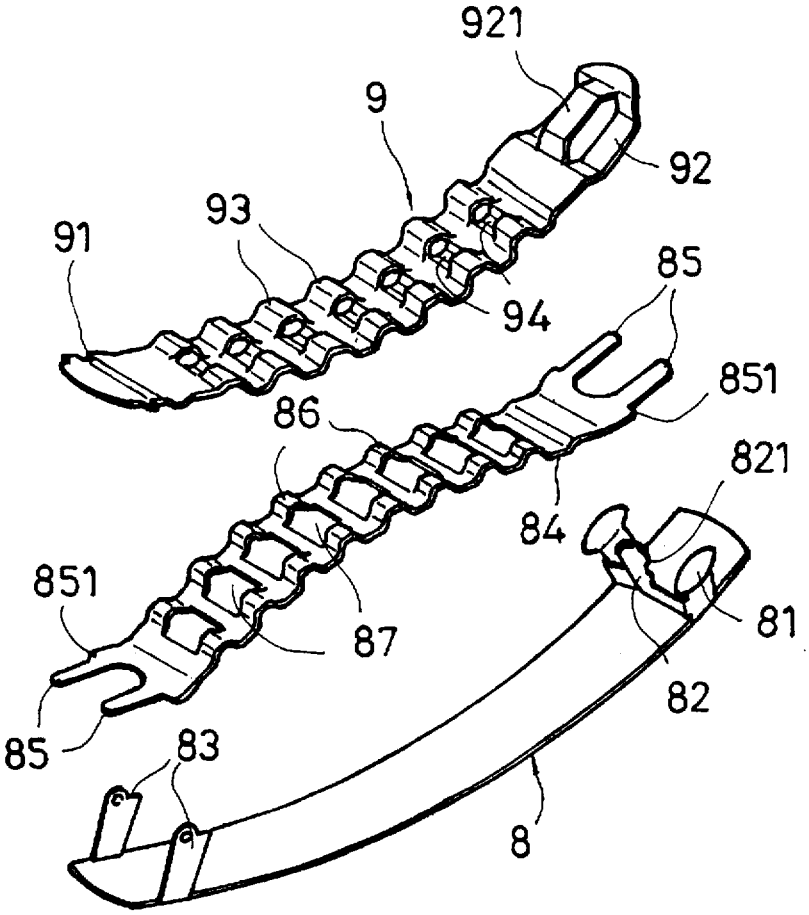
FIG. 7 is an elevational exploded view of a fourth preferred embodiment of the hair clip of the invention.
Figure 7A:
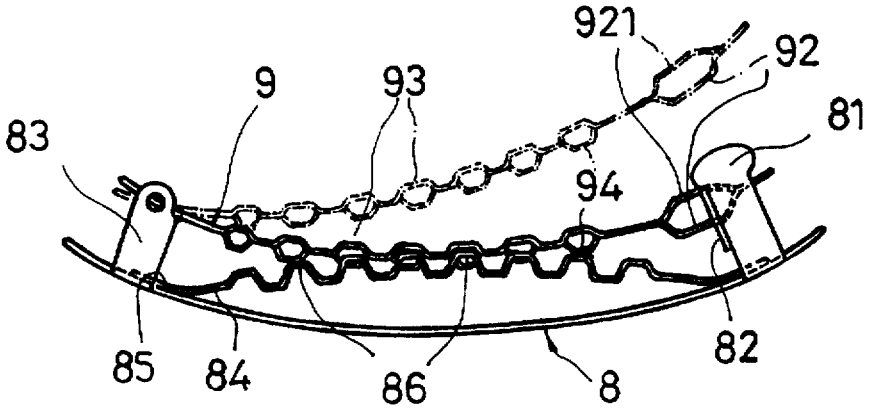
FIG. 7A is a side view of the fourth preferred embodiment of the hair clip of the invention.
Figure 8:
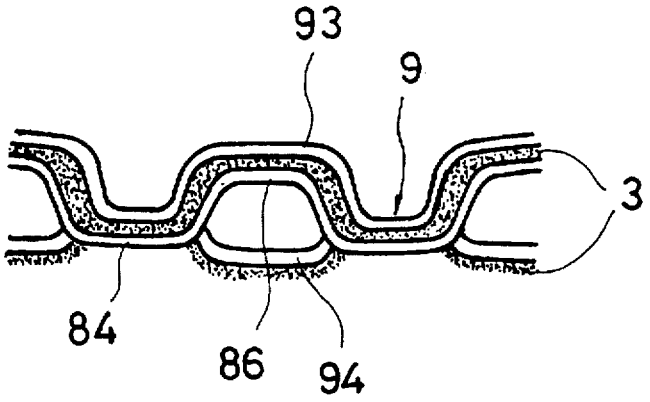
FIG. 8 is an partially enlarged side view of the hair clip according to the fourth preferred embodiment of the invention.
Figure 8A:
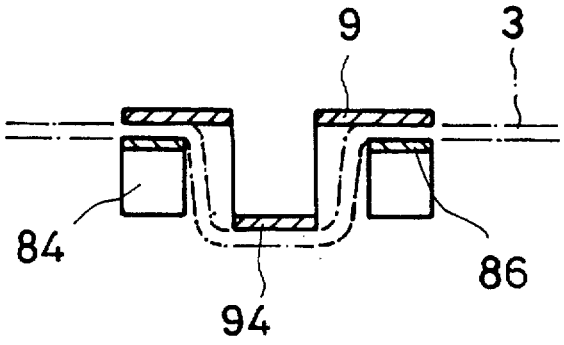
FIG. 8A is a sectional view of the hair clip according to the fourth preferred embodiment of the invention.

With reference to FIGS. 3, 3A, 3B, 4, 4A and 4B, which show a second preferred embodiment of the present invention, an upper clip portion 4 has an upper leaf 41 which is provided with a rounded projection 411 at a front end thereof, while a lower clip portion 5 has a lower leaf 51 provided with a rounded projection 511 at a front end thereof. These rounded projections 411, 511 are provided such that there is a suitable distance between the lower leaf 51 and the head of the wearer to prevent hurting the head. A plurality of substantially round projections 412 which are spaced apart from each other at a suitable distance are provided at either lateral side of a lower surface of the upper leaf 41. Correspondingly, a plurality of substantially round projections 512 which are spaced apart from each other at a suitable distance are provided at either lateral side of an upper surface of the lower leaf 51. These projections 412, 512 are arranged in an alternate manner so that they may engage each other. Furthermore, a plurality of hollowed portions 513 are provided between the two arrays of projections 512, as shown in FIG. 3. Correspondingly, the lower surface of the upper leaf 41 is provided with a plurality of middle projections 413 between the two arrays of projections 412. By means of the engagement of the projections 412 and the 512 as well as the engagement of the hollowed portions 512 and the middle projections 413, the hair clip of this embodiment may achieve a better gripping force which is evenly distributed.

With reference to FIGS. 5, 5A, 5, 6A and 6B, which show a third preferred embodiment of the present invention, the respective front ends of an upper leaf 61 of an upper clip portion 6 and a lower leaf 71 of a lower clip portion 7 of the hair clip are provided with a substantially semi-circular curved projection 611, 711 for preventing the hair clip from hurting the head of the wearer. The opposing surfaces of the upper leaf 61 and the lower leaf 71 are respectively provided with a plurality of spaced apart upper projections 612, 712 which may engage each other. An array of lower projections 613 are provided between the upper projections 612 of the upper leaf 61. Furthermore, a notch 614 is provided at either end of one of the arrays of upper projections 612. A depression 713 is formed between each pair of upper projections 712 on the upper surface of the lower leaf 71. A decorative plate 63 is provided with a couple of engaging portions 632 near both ends thereof for matching the notches 614. It is also provided with an integrally molded fastening end 631 at a front end thereof for matching the semi-circular curved projection 611. By means of the engagement of the upper projections 612, 712 as well as that of the lower projections 613 and the depressions 713, the hair 3 may be firmly gripped by an evenly distributed force in a wavy form. The decorative plate 63 may be easily coupled with the upper clip portion 6 by means of its engaging portions 632 and the fastening end 631.

With reference to FIGS. 7, 7A, 8 and 8A, which show a fourth embodiment of the present invention, one end of a curved decorative plate 8 is provided with a couple of integrally formed press portions 81 disposed opposite to each other. Each press portion 81 extends integrally to form an engageable fastening hook 82 with two fastening ends 821. The other end of the decorative plate 8 is provided with a couple of pivot portions 83 disposed at opposite sides. A lower fastening element 84 having a curvature and resilience is disposed on the decorative plate 8. The lower fastening element 84 has each end provided with a fork portion 85 with two fork tips 851. By means of the resilience of the lower fastening element 84, the fork tips 851 may urge against the press portions 81 and the pivot portions 83 to secure the decorative plate 8 and the lower fastening element 84 together. An upper fastening element 9 is disposed at an upper side of the lower fastening element 84. The upper fastening element 9 has one end provided with a hooking end 91 capable of fastening onto the pivot portions 83 of the decorative plate 8 and the other end provided with two depressed fastening portions 92 and a middle projection 921. The fastening portions 92 may engage the fastening ends 821 of the fastening hooks 82. By pressing the press portions 81 inwardly, the fastening hooks 82 may release the fastening portions 92 to separate the upper fastening element 9 from the lower fastening element 84. The direction of the curvature of the upper fastening element 9 is the same of that of the decorative plate 8, whereas the curvature of the lower fastening plate runs in an opposite direction. By means of this arrangement, the respective middle sections of the upper fastening element 9, the lower fastening element 84 and the decorative plate 8 may be in close contact with one another. A plurality of upper projections 93 which are spaced apart from each other at a suitable distance are provided with each lateral side of an upper surface of the upper fastening element 9. An array of middle depressions 94 which project downwardly are disposed between the two arrays of upper projections 93. Similarly, the lower fastening element 84 is provided with two arrays of projections 86 at both lateral sides, with a plurality of hollowed portions 87 formed between the two arrays. By means of the arrangement of the projections 93 and 86 as well as the middle depressions 94 and the hollowed portions 87, the hair 3 may be firmly gripped between the upper and lower fastening elements 9, 84.

In summary, the hair clip according to the present invention utilizes surfaces with alternating projections to achieve a suitable gripping effect. Although the present invention has been illustrated and described with reference to the preferred embodiment thereof, it should be understood that it is in no way limited to the details of such embodiment but is capable of numerous modifications within the scope of the appended claims.

What is claimed is:

1. A hair clip, comprising:

upper and lower clip portions pivotally connected to each other at rear ends thereof by means of a torsion spring and having a closed and an open position, said upper clip portion including an elongated curved upper leaf, and said lower clip portion including an elongated curved lower leaf;

said upper and lower leaves engaging each other in said closed position, along substantially a full length thereof;

said upper leaf having a tongue like recess extending centrally therealong and a plurality of projecting depressions evenly spaced apart centrally along said tongue-like depression substantially throughout a full length thereof, said projecting depressions extending downwardly from the upper leaf towards the lower leaf;

a plurality of evenly spaced apart side projections disposed at each side of the lower leaf, said side projections extending upwardly from the lower leaf directed towards the upper leaf and spatially alternating with said projecting depressions of the upper leaf;

the side projections on the lower leaf engaging the upper leaf along respective sides thereof when in said closed position, and said projecting depressions on the upper leaf engaging said lower leaf therealong and between said side projections thereon, thereby evenly distributing the hair in wave-like form and preventing the clip from slipping from the hair; and a depressed portion extending from a front end of the lower leaf for spacing said lower leaf from contiguous contact with a user's head and avoiding impingement of said user's head by said front end of said lower leaf.

2. A hair clip, comprising:

upper and lower clip portions pivotally connected at rear ends thereof by a torsion spring and having closed and opened positions, an upper clip portion including an elongated curved upper leaf, and a lower clip portion including an elongated curved lower leaf;

a first array of side projections extended along each side of said upper leaf, and an array of middle projections extended along the upper leaf between said first arrays of side projections, said side and middle projections extending from the upper leaf towards the lower leaf;

a second array of side projections extending towards the upper leaf disposed along each side of said lower leaf, and an array of hollowed portions extended on the lower leaf between said second arrays of the side projections thereon, each of said hollowed portions extending between respective two aligned side projections;

said side projections on the upper leaf engaging the side projections on the lower leaf when said hair clip is in said closed position on respective sides thereof, thereby distributing hair in a neat wavy pattern therebetween, and said middle projections on the upper leaf being received in respective hollow portions on the lower leaf, thereby providing an improved gripping effect.

3. The hair clip of claim 2, further including a first rounded end portion extending downwardly from a front end of the upper leaf, and a second rounded end portion extending downwardly from a front end of the lower leaf, said second rounded end portion preventing the head of a wearer from being impacted by said front end of the lower leaf.

4. The hair clip of claim 2, wherein said side projections on the upper and lower leaves, and said middle projections are evenly spaced apart along the respective leaves.

5. A hair clip comprising:

upper and lower clip portions pivotally connected at rear ends thereof by a torsion spring, said hair clip having a closed and an opened position, an upper clip portion including an elongated curved upper leaf, and a lower clip portion including an elongated curved lower leaf;

a first array of upwardly extending side projections extended along each side of said upper leaf, and an array of downwardly extending middle projections extended along said upper leaf and between said first arrays of the side projections;

a second array of upwardly extending side projections extended along each side of said lower leaf, and an array of downwardly projecting depressions extended along said lower leaf and between said second arrays of the side projections;

said side projections on the upper and lower leaves engaging each other when said hair clip is in said closed position, and said middle projections of the upper leaf being received in the depressions of the lower leaves; and a decorative plate removably attachable to said hair clip.

6. The hair clip of claim 5, further including semi-circular curved projections extending downwardly from front ends of the upper leaf and the lower leaf.

7. The hair clip of claim 6, further including at least one notch formed on at least one upwardly extending side projection of the upper leaf, wherein said decorative plate further includes a fastening end and at least one engaging portion, and wherein said decorative plate is secured to the hair clip by means of engaging said fastening end thereof with said semi-circular curved projections at the front ends of said upper and lower leaves and further by means of engaging said at least one engaging portion on the decorative plate with said at least one notch formed on the upper leaf.

* * * * *